United States Patent [19]

Hunter, Jr.

[11] 3,983,648

[45] Oct. 5, 1976

[54] CHANGEABLE MESSAGE SIGN WITH GAP CLOSURE APPARATUS

[76] Inventor: E. Tait Hunter, Jr., 384 Redwood Drive SW., Marietta, Ga. 30060

[22] Filed: Aug. 7, 1975

[21] Appl. No.: 602,788

Related U.S. Application Data

[63] Continuation-in-part of Ser. No. 399,537, Sept. 21, 1973, Pat. No. 3,919,794.

[52] U.S. Cl. ..... 40/30; 40/777

[51] Int. Cl.[2] ..... G09F 11/02

[58] Field of Search ..... 40/30, 33, 77, 77.4, 40/77.6, 77.7

[56] References Cited

UNITED STATES PATENTS

| | | | |
|---|---|---|---|
| 714,839 | 12/1902 | Watson et al. | 40/77.7 |
| 729,599 | 6/1903 | Jolly | 40/77.7 |
| 790,739 | 5/1905 | McNeal | 40/77.7 |
| 1,058,698 | 4/1913 | Goldstein | 40/77.7 |
| 1,161,853 | 11/1915 | Forbes | 40/33 |
| 1,256,645 | 2/1918 | Barnett | 40/77.7 |
| 1,308,658 | 7/1919 | Carr | 40/77.7 |
| 1,652,335 | 12/1927 | Wiley | 40/30 |
| 3,367,049 | 2/1968 | Noreen | 40/77.7 |

FOREIGN PATENTS OR APPLICATIONS

| | | | |
|---|---|---|---|
| 421,872 | 12/1924 | Germany | 40/77.7 |
| 721,511 | 11/1966 | Italy | 40/77.7 |
| 495,065 | 11/1938 | United Kingdom | 40/77.6 |

*Primary Examiner*—Louis G. Mancene
*Assistant Examiner*—John H. Wolff
*Attorney, Agent, or Firm*—Jones, Thomas & Askew

[57] ABSTRACT

Sign apparatus having a message display space, a number of message support elements which are movably positionable within the message display space, and apparatus for automatically closing gaps which occur in the message display space when the message support elements are repositioned. The message support elements are periodically rotated to change the message appearing in the message display space, and gap closure elements are operatively interconnected with the message support elements to occupy gaps which would otherwise be visible in the message display space due to the offset message support faces on the message support elements. Several embodiments of the present sign apparatus are disclosed.

8 Claims, 25 Drawing Figures

CHANGEABLE MESSAGE SIGN WITH GAP CLOSURE APPARATUS

This is a continuation-in-part of application Ser. No. 399,537 filed Sept. 21, 1973 and now U.S. Pat. No. 3,919,794.

This invention relates in general to message display apparatus and in particular to sign apparatus for sequentially displaying multiple messages.

It has been proposed to provide message sign apparatus having message display spaces in which periodically changeable messages automatically appear, so that the message display spaces will sequentially and repetitively present at least two different messages for observation. Such multiple message signs, while appropriate for a wide variety of locations and applications, are especially useful for relatively small signs of the type in which the sign messages are preferably displayed in movable type or other indicia which is manually affixed to the message support elements of the sign, so that the several messages can be inexpensively replaced from time to time. Such relatively small signs are frequently mounted on wheels and are then known as "trailer signs," while in other applications such signs may be mounted on posts or other fixed supports to provide a permanently installed sign for a commercial establishment or the like.

An example of a multiple message sign apparatus is shown in the aforementioned copending application Ser. No. 399,537. That sign apparatus utilizes a number of separate elongate message support members, each of which is mounted for rotation on an axis and each of which has a parallelogram cross-section configuration in a plane perpendicular to the axis of rotation. The message support members are mounted in a support frame with all axes of rotation disposed in a single plane, and the message support members are interconnected by a movement linkage so that the message support members are oscillated in unison between first and second positions which place selected message support surfaces of the members in message display alignment through two viewing openings on opposite sides of the support frame. Since the messsage support surfaces of the parallelogram-shaped message support members are offset relative to the axes of rotation, however, a gap will be present between one of the message support surfaces and an adjacent support frame; the location of this gap shifts from one end of the message display space to the other end of such space, and also shifts between adjacent back-to-back display spaces of a two-sided sign, as the message support members oscillate in unison to change the message which appears in the viewing openings. These gaps are unsightly and break up the continuity of an otherwise continuous message surface in the sign frame opening. Furthermore, part of the otherwise hidden messages on the end prisms would be partially visible in the cavity and could present a confusing array.

The aforementioned copending application Ser. No. 399,537 discloses apparatus for selectively closing these gaps as the message support members oscillate and the gaps periodically occur in the message display spaces. Such structure as disclosed in the copending application takes the form of an additional pair of prism-like members in the shape of a separate elongate three-dimensional trapezoidal body mounted at each end of the array of message support elements and interconnected with the message support elements to move the respective end members into and out of position to fill the gaps, as the message support members are oscillated. While this gap-filling structure in the aforementioned copending application was found to work well in an actual embodiment of the invention, it is nonetheless recognized that novel alternative gap-filling structure may be provided which is less expensive to construct and which may offer other advantages. Furthermore, it should be realized that the principles of such multiple message sign apparatus can be applied to such signs which have a single message viewing opening.

Accordingly, it is an object of the present invention to provide improved multiple message sign apparatus.

It is another object of the present invention to provide improved multiple message sign apparatus in which no gaps or blank regions are presented to a viewer.

It is a further object of the present invention to provide improved multiple message sign apparatus including structure for selectively occupying gap which would otherwise be unoccupied by message support structure.

It is still another object of the present invention to provide improved multiple message sign apparatus with either one or two message display faces.

Other objects and advantages of the present invention will become more readily apparent from the following description of several disclosed embodiments, as shown in the Figures wherein:

FIG. 1 shows a front elevation view of a disclosed embodiment of a double-spaced multiple message sign apparatus, taken toward one of the message viewing sides;

FIGS. 2A, 2B, 2C, and 2D are section views taken along line 2—2 of FIG. 1, showing the two end message support members and the end structure in a sequence of oscillation between a first message display position and a second message display position;

Stated in general terms, the multiple message sign apparatus of the present invention includes an end member which is movably mounted adjacent to the movable message support element at each end of an array of message support elements. Each end member is provided with operating means which selectively and positively shifts the end member between opposed spaced apart message display openings to fill the gaps alternatively created on opposite message viewing openings, as the message support members oscillate between message display positions. Both rigid and non-rigid end members are disclosed.

Figure 1:
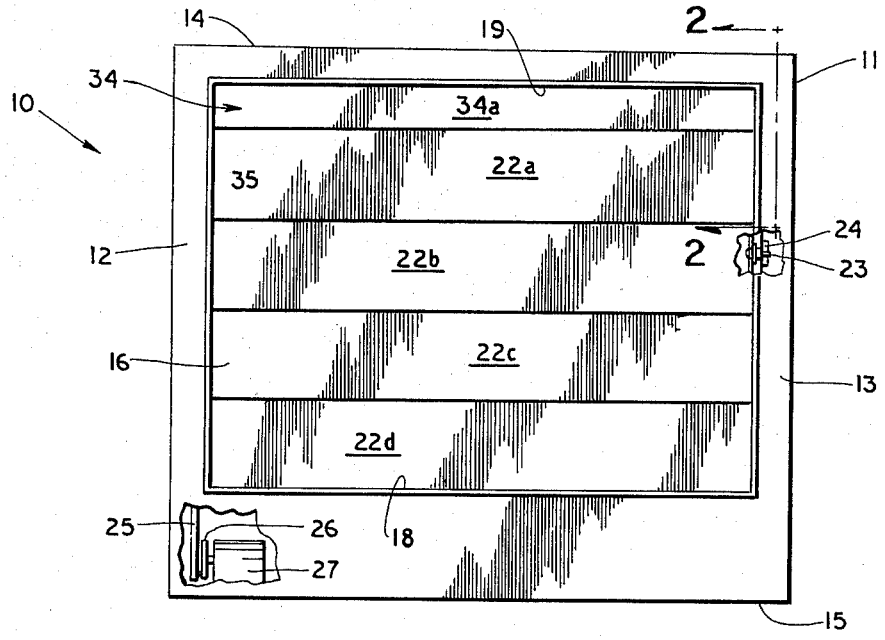

Turning first to FIG. 1, there is shown generally at 10 a multiple message sign apparatus according to a disclosed first embodiment of the present invention and including a housing 11 having a pair of side members 12 and 13, an upper end member 14, and a lower end member 15. The side members and end members define a pair of message display openings 16 (FIG. 1) and 17 (FIG. 2(A)). The lower and upper members have, respectively, an upper frame edge 18 and 19 which define the vertical extent of the message display openings. It will be understood that the entire sign apparatus 10 can be provided with suitable supportive or mounting structure, forming no part of the present invention, such as a mobile trailer or a means for attaching the sign apparatus to a post or other structure.

A plurality of message support members 22*a*, 22*b*, 22*c*, and 22*d* are mounted within the housing 11, with such members being mounted for rotation on individual coplanar axes that are substantially parallel with each other and with the upper and lower frame edges 19 and 18. A somewhat generalized view of the rotational axes for the message support member 22*b* is shown in breakaway in FIG. 1, with the axis 23 of that end member being mounted within a side member bracket 24 for rotation. A more detailed description of axial mounting structure which may be used for the message support members is found in the aforementioned copending application.

Although four separate message support members are provided in the disclosed embodiment, it will become apparent that the choice of four is by way of example only and that a greater or lesser number of message support members can be utilized in a sign apparatus if desired. Each of the message support members 22*a*–22*d* has a first pair of parallel sides $x$–$x'$ and a second pair of parallel sides $y$–$y'$, as designated in FIGS. 2A–2D, and it can be seen that the two pairs of sides $x$–$x'$, $y$–$y'$ define the parallelogram cross-section configuration of each message support member. The exterior surfaces of the sides $x$, $x'$ and $y$, $y'$ are used to support numerals, letters, or other message indicia.

The several message support members 22*a*–22*d* are interconnected to be oscillated in unison between a first position, in which all sides $x$ are in parallel alignment for viewing through message display opening 16 and all sides $x'$ are in parallel alignment for viewing through the opposite message display opening 17, and a second position in which all sides $y$ and $y'$ are correspondingly aligned for viewing through the message display openings 16 and 17. Each of the message support members is interconnected with a linkage for oscillation in unison, with one such linkage being shown in the aforementioned copending application. The linkage can terminate in a drive link 25 connected to the drive wheel 26 of a motor 27 mounted within the lower end member of the sign apparatus, for example.

Since the message support surfaces of each message support member are offset relative to the axis about which the message support member oscillates, a gap 28*a* or 28*b* of substantial extent exists between one edge of each array of aligned parallel sides $x$, $x'$ (or $y$, $y'$) and one of the frame edges 18 and 19 which define the viewing openings 16 and 17. The occurrence and location of one such gap is exemplified in FIG. 2(A), for example, wherein the side $x$ of the message support member 22*a* is spaced apart from the upper frame edge 19 by the gap 28*a*. Similarly, the side $x'$ of the lowermost message support member 22*d* is spaced apart from the lower frame edge 18 by a gap (not shown) at the lower edge of the message display opening 17.

These gaps 18 become transposed to opposite sides of the sign apparatus when the message support members oscillate in unison to change message display signs, with the gap 28*a* appearing at the top of the message display opening 17 as the gap 28*b*.

The aforementioned gaps are filled, according to the embodiment of the invention shown in FIGS. 2(A-)–2(D), by providing a double-sided slat end member 34 which is longitudinally coextensive with the length of the end member 22*a*, and which has a height somewhat greater than the extent of the gap 28. The slat end member 34 is attached to the message support member 22*a* by a resilient connection 38 extending along an attachment line 35 which is parallel to the rotational axis 23 of the message support member, and the line of attachment 35 preferably coincides with the intersection of the sides $x$ and $y$ of the message support member. The resilient connection 38 of the slat end member 34 to the message support member 22*a* is biassed so that the slat end member 34 normally assumes an upstanding position, as shown in FIGS. 2B and 2C, in which the slat end member defines an obtuse angle with both of the support member sides $x$ and $y$.

The slat end member 34 is provided with a striker member 36 along its unconnected longitudinal edge, and a pair of striker plates 37*a* and 37*b* are provided within and along opposite interval sides of the upper end member 14 of the sign apparatus.

The slat end member 34 is rigid and relatively thin, as shown in FIGS. 2A–2D, and the slat member may be provided by a unitary member of any suitable material. The slat member 34 may, for example, be a rigid elastomeric or plastic material having a resilient connection 38 provided by an integral resiliently deformable hinge strip extending outwardly from one or several places along the edge of the slat member and received within the line of attachment 35 of the message support member 22*a*. Alternatively, the connection 38 can be a spring member or a spring-loaded hinge extending along the edge of the slat end member 34, or a number of separate spring members located at spaced-apart intervals along the edge of the slat.

The lowermost message member 22*d* is provided with a slat end member (not shown in FIG. 2) which is substantially identical in all respects to the slat end member 34 previously described. The slat end member is attached at the intersection between the sides $x'$ and $y'$ of the lowermost message support member 22*d*, and includes a resilient interconnection which may advantageously be provided by the aforementioned integral hinge flap construction.

The message support member 22*a*, as well as all of the other message support members not shown in FIGS. 2A–2D, are pivotally interconnected by the linkage 44 for oscillation in unison about the respective parallel coplanar axes of rotation, and it will be understood that the linkage 44 may be connected with the driving link 25 in any appropriate manner.

Figure 2A:
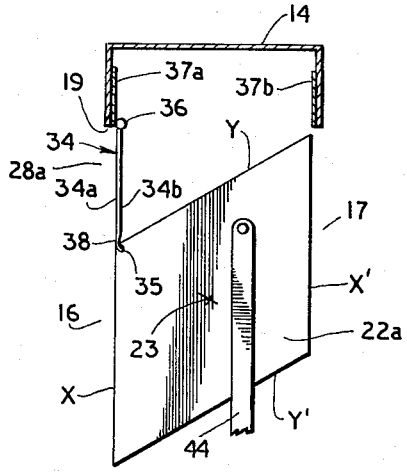

Considering the operation of the embodiment described in FIGS. 2A–2D, it is assumed that the message support members 22*a* initially occupies the position shown in FIG. 2A. The striker member 36 of the upper slat end member 34 has contacted the striker plate 37*a* within the upper end 14 of the sign housing, causing the resilient hinge flap connection 38 to bend so that the side 34*a* of the slat end member occupies the gap region 28*a* and is in substantially plane alignment with the side $x$ of the message support member 22*a*. At the same time, it will be understood that the corresponding side of the lower slat end member (not shown) is aligned with the side $x'$ of the message support member 22*d*, thereby occupying the gap region which would otherwise exist at one side of the lower end of the message display opening 17.

Figure 2B:
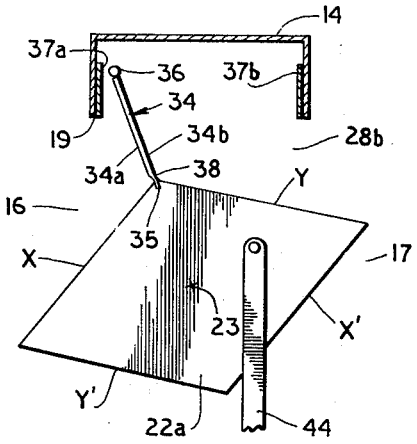
Figure 2C:
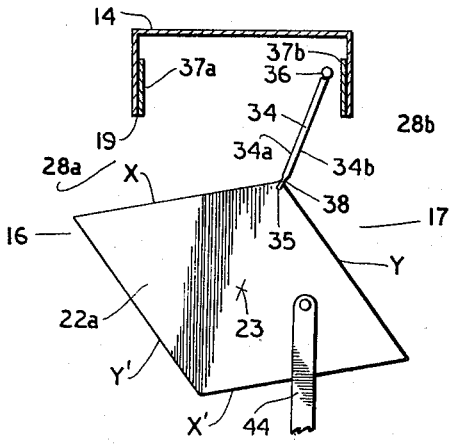
Figure 2D:
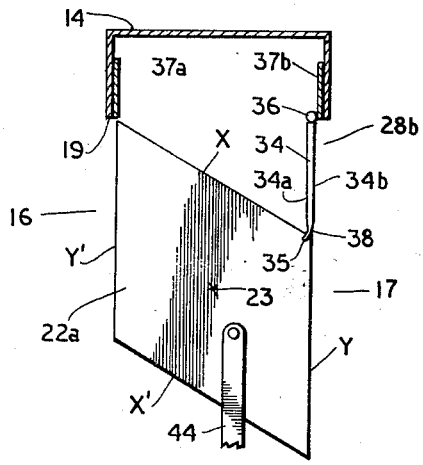

As the message support members 22*a*–22*d* commence to oscillate in unison about their respective axes in response to movement of the linkage 44, the slat end member 34 is withdrawn from the gap region 28*a* as shown in FIG. 2(B). The resilient interconnection between the slat end member and the respective message support member allows the slat end member to assume the upstanding position shown in FIG. 2(B) and 2(C) as the message support members progressively move to the new message display position. The striker member 36 of the upper slat end member 34 now contacts the striker plate 37*b* within the housing, and the message change oscillation continues until terminating at the new display position shown in FIG. 2(D), wherein the resilient connection 38 is deformed as the side 34*b* of the upper slat end member 34 has become aligned with the side $y$ of the message support member 22*a*. At the same time, corresponding side of the lower slat end member is aligned with the side $y'$ of the message support member 22*d*. The slat end member sides 34*a* and 34*b* thus completely occupy the gaps which would otherwise periodically appear at the upper end of the respective message display openings 16 and 17.

Although the changeable messages are normally carried only on the sides $x$, $x'$ and $y$, $y'$ of the several message support members 22*a*–22*d*, it will be apparent that the sides of the slat end members can also be provided with message indicia of any appropriate nature.

Turning to the alternative embodiment shown in FIGS. 3(A)–3(D), each of the aforementioned slat end members has been replaced by a guided pivot end member, with one such guided pivot end member being shown at 50. The end member 50 includes a pair of gap filling surfaces 51 and 52 each having an elongate extent substantially comparable to the length of the sides $x$, $x'$ and $y$, $y'$ of the message support members; the gap filling surfaces 51 and 52 of the end member 50 converge along an edge 53 which is hinged to the intersection of edges $x$ and $y$ of the message support member 22*a*. The hinge connection at 53 need not be a resilient or spring-loaded hinge, as will become apparent.

A support member 54 is connected to the ends of the gap filling surfaces 51 and 52 spaced outwardly from the hinge connection at the edge 53, and a bracket 55 is secured to the support member 54. The bracket 55 contains an elongate slot 55', and a fixed guide member 56, which may be a roller member or the like, extends through the slot 56 and is suitably secured within the upper end member 14.

Although not shown in FIGS. 3(A)–3(D), it will be understood that the lowermost message support member 22*d* is provided with a comparable guided pivot end member which may be substantially identical to the end member 50, and which is hingedly attached to the message support member 22*d* at the junction of sides $x'$, $y'$ thereof.

Figure 3A:
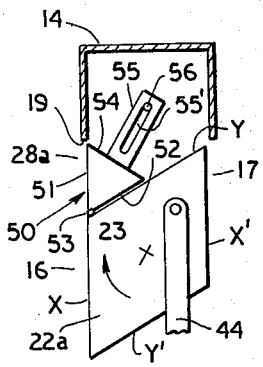
FIGS. 3A–3D show a section view taken along line 2—2 of an alternative disclosed embodiment of the present invention in the same sequence of oscillation.
Figure 3B:
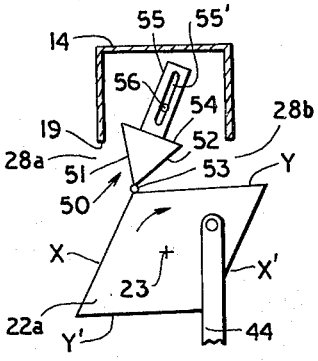
Figure 3C:
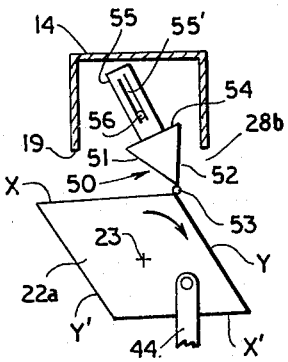
Figure 3D:
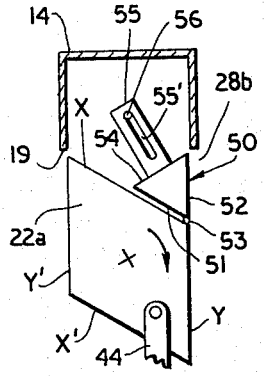
Figure 4A:
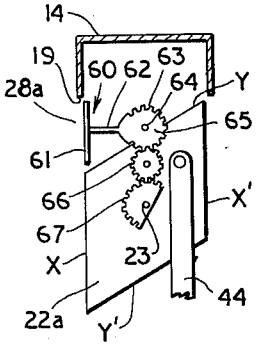
FIGS. 4A–4D show a section view taken along line 2—2 of still another disclosed embodiment of the present invention in a sequence of oscillation.
Figure 4B:
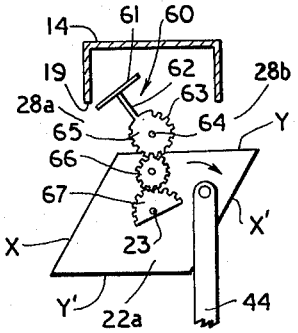
Figure 4C:
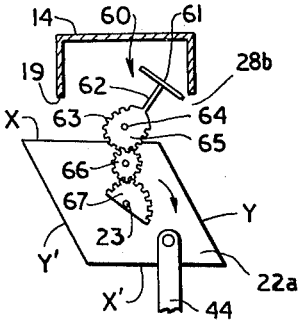
Figure 4D:
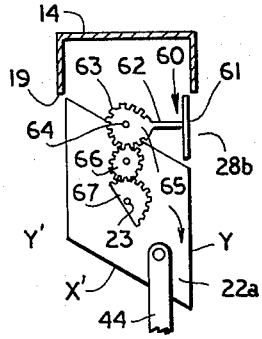

Considering the operation of the embodiment depicted in FIGS. 3(A)–3(D), the gap filling surface 51 of the end member 50 is in substantially parallel alignment with the side $x$ of the upper message support member 22*a* when in the position of FIG. 3(A), so that the surface 51 fills the gap region 28*a* which would otherwise exist between the message support member and the upper frame edge 19. As the message support member 22*a* commences to oscillate toward the position shown in FIG. 3(B), the end member 50 is allowed to move upwardly within the upper end member 14 because of the slotted interconnection between the slot 55' and the guide 56. The end member 50 continues to pivot about the hinged connection 53 to the message support member 22*a* as rotation progresses to the position shown in FIG. 3(C), whereat the end member 50 is commencing to move downwardly along the slotted interconnection. When the message support member 22*a* assumes the terminal position shown in FIG. 3(D), the end member 50 has moved to a position in which the gap filling surface 52 is now substantially parallel with the side $y$ of the message support member so as to occupy the gap region 28*b* which would otherwise exist. The gap filling surface 51, is, at this time, substantially adjacent to the now-hidden side $x$ of the message support member 22*a*, within the upper end member 14 of the housing 11.

Turning to the embodiment shown in FIGS. 4(A-)–4(D), the gap 28*a* between the downwardly-offset side $x$ of the message support member 22*a* and the upper frame edge 19 of the upper end member 14 is filled with a single end member 60 having a gap filling surface 61 of height sufficient to occupy substantially the entire vertical extent of the gap 28*a* and of length substantially coextensive with the longitudinal dimension of the message support member 22*a*. The end member 60 is supported at each end by driver arms one of which is shown in FIGS. 4(A)–4(D) at 62. The driver arm 62 terminates at an inner end 63 which pivots for rotation on an axis 64 which may be mounted in a fixed location within the housing 11.

The inner end 63 of the driver arm 62 is provided with a gear segment 65 which meshes with an idler gear 66 also pivotally mounted at a fixed location within the housing 11. The idler gear 66 is driven by the gear segment 67 which is mounted on the end of the uppermost message support member 22*a* for rotation therewith, coaxial with the axis of rotation 23. It is apparent from FIG. 4(A) that the end member 60 is positioned to place the gap filling surface 61 in substantial alignment with the side $x$ of the message support member 22*a*, when in the first message display position. As the message support member 22*a* is rotated to the position shown in FIG. 4(B) during the message change cycle, the driver arm 62 is moved upwardly by the gear train 67, 66, 65 to swing the end member 61 upwardly into the space within the upper end member 14 of the housing. The end member 60 continues to move through the position shown in FIG. 4(C), in response to rotation of the message support member 22*a*, to terminate in the position shown in FIG. 4(D); the gap filling surface 61 is now aligned with the message display surface y to occupy the gap 28*b* which would otherwise appear on the opposite side of the sign apparatus 10 from the gap 28*a* initially occupied by the gap filling surface. The gear train 67, 66, 65 (or any alternative interconnective mechanism) must rotate the end member 60 approximately 180° of rotation. The message support member 22*a* undergoes a complete rotation between message display position. In the case of sign apparatus utilizing message support members which rotate approximately 120° between message display positions, a 3:2 drive interconnection is provided between the message support member 22*a* and the end member 60. It will also be understood that the lower message support member 22*d* of the sign apparatus is equipped with gap filling apparatus which is substantially similar to that shown in FIGS. 4(A)–4(D).

The embodiment shown in FIGS. 5(A)–5(D) utilizes an end member 71 having a pair of gap filling surfaces 72 and 73 which respectively are moved into position to occupy the gaps 28*a* and 28*b* on opposite sides of the sign apparatus, between the uppermost message support member 22*a* and the upper end member 14 of the sign housing. The end member 71 is pivotally connected at 74 to the message support member 22*a* at the line of intersection between the sides *x* and *y*, and the upper end of the end member 71 is pivotally connected at 75 to one arm 76 of a crank link 77.

The crank link 77, which includes another arm 79 joining the arm 76 at approximately a right angle, is pivotally connected at 78 to a fixed location such as one of the sign apparatus side members 12 and 13. The outer end of the crank arm 79 is pivotally connected at 80 to the link 81, whose other end is pivotally connected at 82 to a position which is offset on the end of the message support member 22*a* a distance from the axis 23 of end member rotation.

Understanding of the embodiment shown in FIGS. 5(A)–5(D) is facilitated if the end member 71, combined with the arm 76, the pivots 74, 75, 78, and 82, and the axis 23, are considered to define a basic four-bar linkage which translates the end member 71 from one gap position 28*a* to the other gap position 28*b* as the end member 22*a* oscillates from one viewing position to the other. A secondary four-bar linkage containing the link 81, along with the pivots 78, 80, 82, and the axis 23, is interconnected with the aforementioned first four-bar linkage to assure that the first four-bar linkage will travel over-center when pivot points 74, 75, 78, and the axis 23 are momentarily aligned at mid-point between the two message viewing positions at FIGS. 5(A) and 5(B).

Figure 5A:
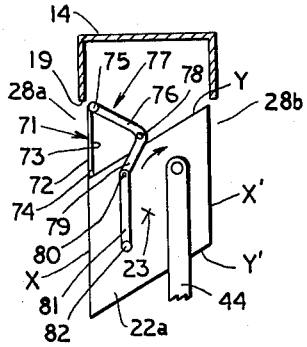
FIGS. 5A–5D show a section view taken along line 2—2 of still another embodiment of gap filling structure according to the present invention in a sequence of oscillation.
Figure 5B:
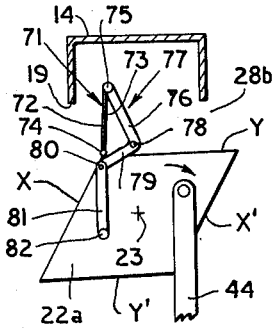
Figure 5C:
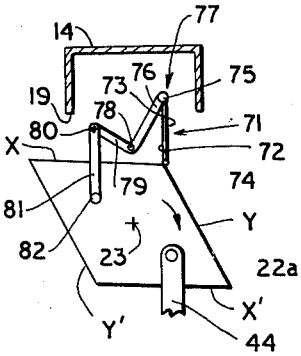
Figure 5D:
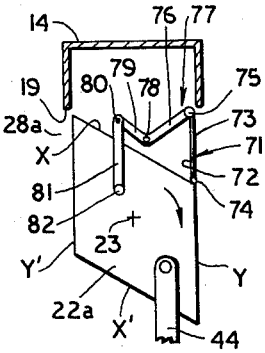

It will be understood from the foregoing that the end member 71 is oscillated between a first position shown in FIG. 5(A), whereat the gap filling surface 72 occupies the gap region 28*a*, and a second position shown in FIG. 5(D) in which the other gap filling surface 73 occupies the gap region 28*b*. It will additionally be understood that the lower message support member (not shown in FIG. 5) is similarly equipped with end member structure.

Turning to FIGS. 6(A)–6(D), a pair of non-rigid end members 86 and 87 are provided which occupy the gap regions 28*a* and 28*b* between the upper end member 14 of the sign housing and the uppermost message support member 22*a*. Each of the non-rigid end members 86 and 87 may take the form of a sheet or web of flexible material such as fabric, plastic, or the like having an outer end pivotally attached to the message support member 28*a* at the intersection 88 between message support sides *x* and *y*. The non-rigid end member 86 extends from the pivotal attachment 88 upwardly to wind around a take-up roller 89 which is disposed within the upper end member 14 of the sign housing. The other non-rigid end member 87 similarly extends from the pivotal attachment 88 upwardly to wind around another take-up roller 90. Each of the take-up rollers 89 and 90 is received within the upper end member 14 of the sign housing, and each take-up roller is spring-loaded to rotate in a direction to take up any slack which may exist in the end members 86 and 87. The direction of spring-biased rotation for the take-up rollers 89 and 90 is denoted by arrows denoted 89*a* and 90*a* in FIG. 6(A). The rollers 89 and 90 rotate on respective axes of rotation 91 and 92 which are secured to the side members 12 and 13, or otherwise affixed to the housing 11 of the sign apparatus. The location of each take-up roller axis, combined with the radius of the rollers, is preferably chosen so that the non-rigid end members extend substantially vertically downwardly from the respective rollers for plane alignment with the message support side *x* and *y* in message display position.

Figure 6A:
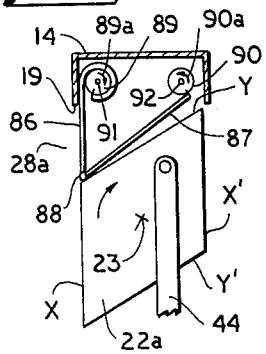
FIGS. 6A–6D show a section view taken along line 2—2 of an alternative embodiment of the present invention, employing non-rigid end members, in the aforementioned sequence of oscillation.

When the message support member 22*a* is in a first message display position as shown in FIG. 6(A), the non-rigid end member 86 extends downwardly from the take-up roller 89 to completely occupy the gap region 28*a* which would otherwise exist between the upper frame edge 19 and the side *x* of the message support member. The other non-rigid end member 86, which is not presently needed to fill a gap, is concealed from view by the end member 86 and by the other message surface *x'* of the message support member 22*a*.

Figure 6B:
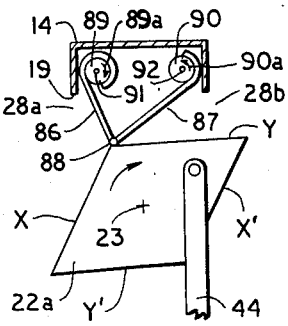
Figure 6C:
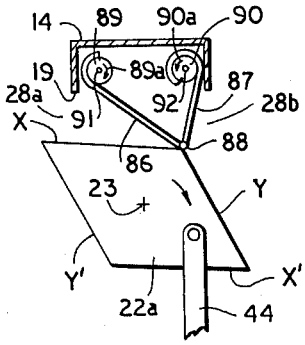
Figure 6D:
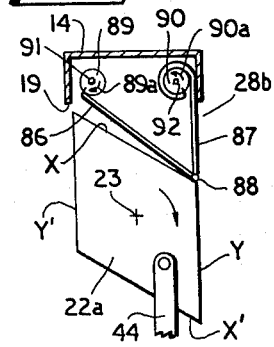

As the message support member 22*a* is rotated to the intermediate position shown in FIG. 6(B), the non-rigid end member 86 is moved inwardly and away from the gap region 28*a* while the other non-rigid end member 87 commences movement toward the other gap region 28*b*. The two non-rigid end members 86 and 87 are kept taut at all times by the spring-loaded take-up rollers 89 and 90. FIG. 6C shows that the non-rigid end member 87 has nearly moved to its final position in alignment with the side *y* of the message support member, while the other non-rigid end member 86 has been drawn substantially within the interior of the housing 11 beneath the upper end member 14. When the final message display position shown in FIG. 6D is reached, the non-rigid end member 87 extends substantially vertically downward from the take-up roller 90 for plane alignment with the message support side *y*. The gap region 28*b* is thus effectively occupied by the non-rigid end member 87, while the other non-rigid end member 86 is hidden from view within the housing of the sign apparatus.

It will be understood that the lowermost message support member 22*d* (not shown in FIG. 6) may be similarly equipped with non-rigid end members of the type shown in FIGS. 6A–6D. It will also be understood that it is possible, although normally not preferable, to provide a particular multiple message sign apparatus with two different embodiments of end member structure, so that the gaps occurring at the upper end of the sign could be filled by apparatus dissimilar to the gap-filling apparatus located at the lower end of the sign.

FIGS. 7A–7D show a version of the multiple message sign apparatus described in the aforementioned co-pending application Ser. No. 399,537 where only a single message display opening is provided instead of opposed message display openings provided in the embodiments described previously. The sign apparatus 98 includes an upper end member 100 and a lower end member 101, with these end members respectively having an upper frame edge 102 and a lower frame edge 103 which define the upper and lower extents of the message display opening 99. The sign apparatus is provided with a back wall 104 which may be a solid panel, and it will be apparent that the back wall can be removably attached to permit access to the interior region 105 of the sign apparatus for maintenance and the like. Although not shown in FIGS. 7A–7D, it is understood that the sign apparatus 98 includes appropriate side members which may be similar to the side members 12 and 13 of the apparatus depicted in FIG. 1.

Mounted within the interior region 105 of the sign apparatus is a series of message support members 106*a*, 106*b*, 106*c*, 106*d*, with each such message support member being supported for oscillation on corresponding axes 107*a–107d* which are mutually parallel and coplanar. Each of the message support members 106*a*–106*d* includes a pair of message support sides *x'*, *y*, which are analogous in function to the aforementioned message support sides in the above-described embodiments of the invention. It is apparent from FIGS. 7A–7D that each of the message support members 106*a–106d* is in the shape of a prism of triangular-section, in which the message support sides *x'* and *y* substantially meet along an edge (in FIG. 7B) which defines an apex of the triangular prism. The prism side which confronts the apex 108, in each triangular message support member 106*a*–106*d*, is provided by suitable interconnecting structure 109 which does not form an additional message support surface.

Figure 7D:
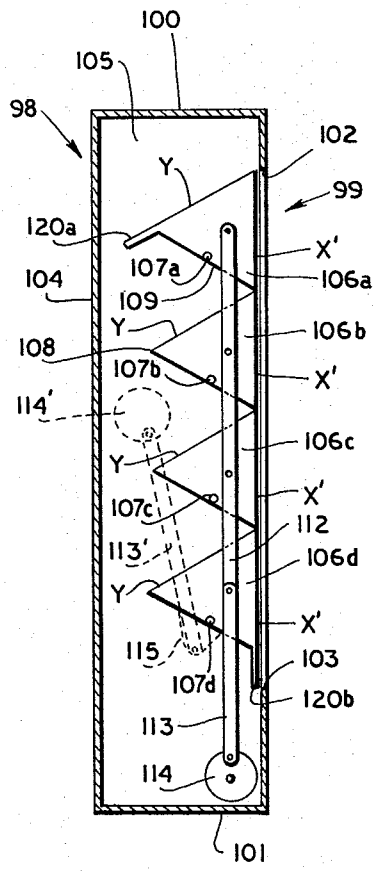
FIGS. 7A–7D show vertical section views of single face sign apparatus according to an embodiment of the invention.
Figure 7C:
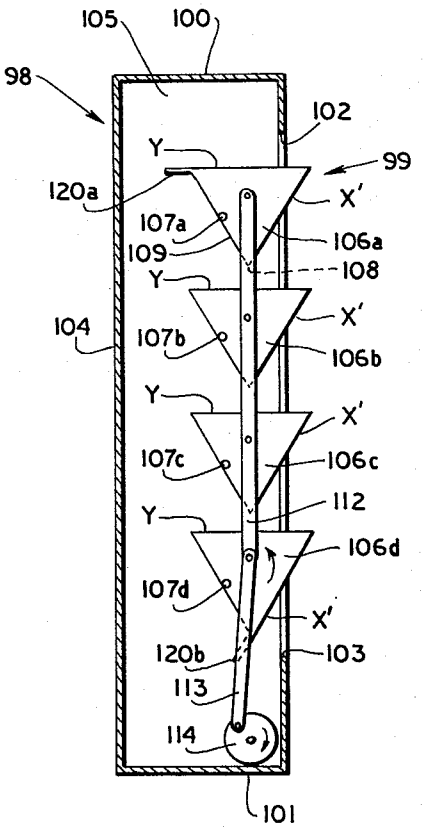
Figure 7B:
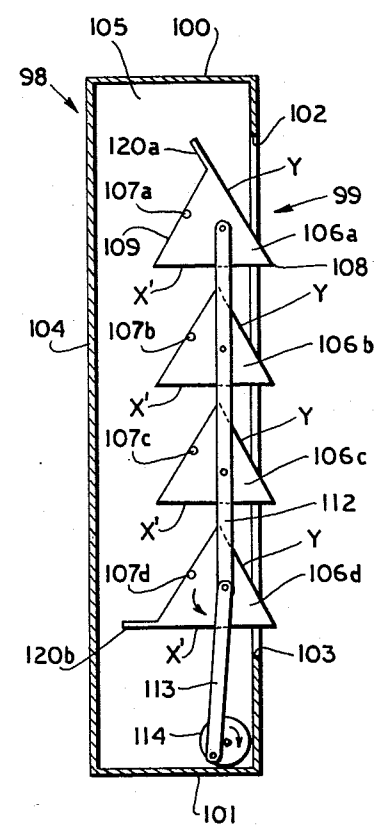
Figure 7A:
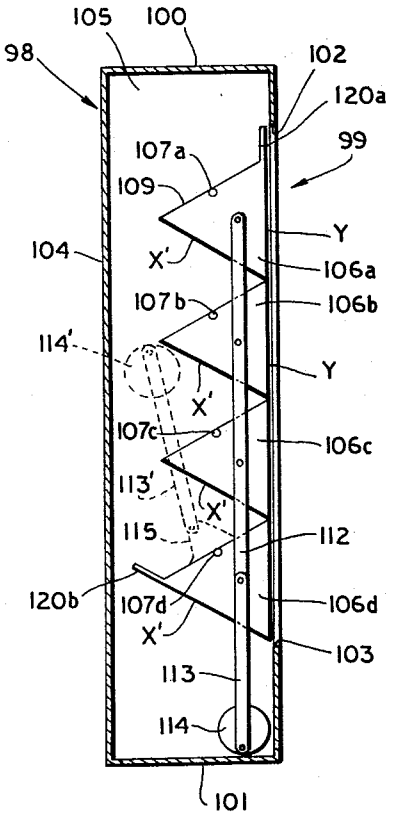

Each of the message support members 106*a*–106*d* is interconnected by the linkage 112 which allows the message support members to be oscillated in unison between a first message display position, shown in FIG. 7A, through the intermediate positions shown in FIGS. 7B and 7C, and to the second message display position shown in FIG. 7D. When in the first message display position of FIG. 7A, all of the message sides *y* are aligned in substantially contiguous position for viewing through the message display opening 99, while in the second message display position shown in FIG. 7D all of the message sides *x'* are similarly aligned within the opening 99.

The interconnected message support members may be driven for oscillation by any suitable motive apparatus, such as the drive link 113 and powered drive wheel 114. Alternatively, as shown in broken line in FIGS. 7A and 7D, a drive link 113' and powered drive wheel 114' can be positioned within the interior region 105 between the message support members and the back wall 106, so that the overall height of the sign apparatus 98 can be reduced. The drive link 113' is pivotally connected to a bracket 115 on one of the message support members 106*d*, with the pivot point between the bracket 115 and the drive link 113' being positioned so that top dead center and bottom dead center of the drive link 113' and drive wheel 114' do not coincide with the axis 107*d* of the driven message support member.

Since each of the message support sides *x'* and *y* of the message support members 106*a*–106*d* is offset with respect to the axis of rotation for the message support member, a gap occurs between the upper frame edge 102 and the side *y* of the adjacent message support member 106*a* in the first message display position shown in FIG. 7A. A similar gap also occurs between the lower frame edge 103 and the side *x'* of the adjacent message support member 106*d*, in the second message display position shown in FIG. 7D. These unsightly gaps are overcome, in the embodiment of FIGS. 7A–7D, by the end members 120*a*, associated with the side *y* of message support member 106*a*, and with the end member 120*b*, associated with the side *x'* of the message support member 106*d*. As seen in FIGS. 7A–7D, each of the end members 120*a* and 120*b* is an extension of the corresponding message sides *y* and *x'*, to an appropriate extent which substantially fills the aforementioned gaps which occur between the upper and lower frame edges. The end members 120*a* and 120*b* are alternately positioned within the interior region 105 as the message support members oscillate between the two message display positions. Either or both of the end members 120*a* and 120*b* may, if desired, be used as additional message display surface.

A single-face sign as shown in FIGS. 7A–7D can readily be back-lighted, particularly where the drive means is located in the lower end of the sign as shown at 114. Such internal backlighting may be accomplished by mounting one or more appropriate sources of illumination in the interior region 105, between the axes 107*a*–107*d* and the inside of the back wall 104. For example, fluorescent lamps can be positioned approximately behind and parallel to each of the aforementioned axes, to provide back illumination through message sides *x'* and *y* made of suitable translucent material.

Furthermore, it will be understood by those skilled in the art that the foregoing relates only to disclosed embodiments of the present invention, and that numerous changes and modifications may be made therein without departing from the spirit and the scope of the invention as defined in the following claims.

I claim:

1. Changeable message sign apparatus comprising:

housing means including a pair of substantially aligned spaced apart registered message display openings each defined by an upper edge and a lower edge, said edges of said housing means being respectively disposed on an upper end member and a lower end member located at the corresponding opposite ends of said message display openings;

a plural number of message support members mounted in said housing means for rotation on separate and coplanar axes;

each of said message support members having message surfaces which are parallel to the respective axis of rotation and which are laterally offset from such axis of rotation, so that said message support surfaces define a parallelogram cross-section configuration of each said message support member;

means operatively connected to said message support members for selectivley oscillating each of said message support members in unison about said axes to occupy either a first message display position or a second message display position;

each of said message support members in said first message display position placing a first set of said message surfaces in message display alignment and substantially abutting in one of said message display openings and a second set of said message surfaces in message display alignment and substantially abutting in the other of said message display openings, and in said second message display position placing third and fourth sets of message surfaces in respective message display alignment with said first and second message display openings;

there being a gap which periodically appears at one said edge of each message display opening and a laterally offset message surface of the adjacent message support member for each said message display position, as said message support members are oscillated to said first and second message display positions;

gap filling means mounted proximate to the said end member which is adjacent to said one edge;

means mounting said gap filling means for selective shiftable positioning to substantially completely occupy either of the gaps which occur between said one edge and said adjacent message support member in either of said message display openings; and means operatively connecting said gap filling means for shifting to said respective gap occupying positions in synchronism with oscillation of said adjacent message support member to said first and second message display positions.

2. Apparatus as in claim 1, wherein:

said gap filling means comprises a slat having first and second gap filling surfaces and attached to said adjacent message support member with resiliently yieldable means which urges said slat to occupy an outwardly extending position relative to adjacent message surfaces of said message support member; and means operative to engage said slat and to deflect said slat from said outwardly extending position as said adjacent message support member is oscillated to said first and second message display positions, so that a selected one of said gap filling surfaces is disposed in alignment with the laterally offset message surface which is adjacent to said gap filling surface.

3. Apparatus as in claim 1, wherein:

said gap filling means includes first and second gap filling surfaces mounted in fixed converging relation to each other along a line;

hinge means pivotally connecting said convergent line of said gap filling means to said adjacent message support member contiguous to the intersection of two adjacent message sides thereof; and means operative to support and guide said gap filling means for movement between a first gap occupying position wherein one of said gap filling surfaces occupies the gap between said one edge and one of said adjacent message sides, and a second gap filling position wherein the other of said gap filling surfaces occupies the gap between said one edge and the other of said adjacent message sides, as said adjacent message support member oscillates between said first and second message display positions.

4. Apparatus as in claim 3, wherein:

said first and second gap filling surfaces are aligned with respect to said adjacent message surfaces so that said first gap filling surface, when in first gap filling position, is substantially parallel to said one adjacent message surface; and said other gap filling surface, when in second gap filling position, is substantially parallel to said other adjacent message surface.

5. Apparatus as in claim 1, wherein:

said gap filling means comprises a single gap filling surface; and pivotal mounting means supporting said gap filling surface within said housing for movement to selectively occupy the gap between said one edge and said adjacent message support member in either of said message display openings.

6. Apparatus as in claim 1, wherein:

said gap filling means comprises a slat having first and second gap filling surfaces;

means pivotally attaching said slat to said adjacent message support member at the intersection of two adjacent message surfaces thereon; and said operatively connecting means comprises linkage means attached to said slat and supporting said slat in substantially coplanar relation to said pair of message display openings as said slat is translated between a first position in which said first gap filling surface is substantially coplanar with one of said adjacent message surfaces and occupies the gap in one of said message display openings, and a second position in which said second gap filling surface is substantially coplanar with the other of said adjacent message surfaces and occupies the gap in the other message display opening.

7. Apparatus as in claim 1, wherein:

said gap filling means comprises nonrigid web means attached to said adjacent message support member at the intersection of two adjacent message surfaces thereon; and roller means disposed in said housing at said one end member to receive and guide movement of said web means in alignment with said gaps as said adjacent end member oscillates between said message display positions.

8. Apparatus as in claim 7, wherein:

said roller means comprises a pair of rollers each of which is adjacent a respective one of said message display openings to guide said web means from each said roller into substantially coplanar gap filling alignment with the respective message surfaces which are aligned in said message display openings.

* * * * *